United States Patent [19]

Tinchon

[11] 4,377,127

[45] Mar. 22, 1983

[54] DEVICE FOR PROJECTING A WALL COATING, PARTICULARLY FOR AN EXCAVATION

[75] Inventor: Lucien Tinchon, Petite Rosselle, France

[73] Assignee: Houilleres Du Bassin de Lorraine, Freyming-Merlebach, France

[21] Appl. No.: 229,265

[22] Filed: Jan. 28, 1981

[30] Foreign Application Priority Data

Jan. 29, 1980 [FR] France ..... 80 01861

[51] Int. Cl.[3] ..... B05C 7/02

[52] U.S. Cl. ..... 118/306; 118/308; 118/315; 118/DIG. 10

[58] Field of Search ..... 118/306, 317, 323, DIG. 10, 118/308, 315; 427/236

[56] References Cited

U.S. PATENT DOCUMENTS

| | | | |
|---|---|---|---|
| 1,971,535 | 8/1934 | Perkens | 118/306 |
| 2,168,917 | 8/1939 | Perkens | 118/317 X |
| 2,297,099 | 9/1942 | Crom | 118/105 |
| 2,922,583 | 1/1960 | Perkens | 118/306 X |
| 3,108,348 | 10/1963 | Schultz | 118/306 X |
| 3,690,560 | 9/1972 | Boyd | 118/306 X |
| 3,810,441 | 5/1974 | Padgett et al. | 118/105 |

FOREIGN PATENT DOCUMENTS

| | | |
|---|---|---|
| 437062 | 11/1967 | Fed. Rep. of Germany . |
| 2808903 | 9/1979 | Fed. Rep. of Germany . |
| 1084168 | 1/1955 | France . |
| 2371627 | 6/1978 | France . |
| 2371242 | 6/1978 | France . |

*Primary Examiner*—John P. McIntosh

*Attorney, Agent, or Firm*—Cushman, Darby & Cushman

[57] ABSTRACT

The present invention relates to a device for simultaneously projecting a liquid or pasty product and a powdery, granulous or fibrous filler to make a reinforced plastic wall coating, in which the product is brought by pumping to a centrifugal projection member with central supply channel, wherein it comprises, for projecting the product, a revolving spray device with its central supply channel and, for projecting the powdery filler, a centrifugal wheel and a means for supplying the filler to the centrifugal wheel, the revolving spray device and the centrifugal wheel being mounted on the same shaft in the vicinity of each other.

4 Claims, 3 Drawing Figures

31
30
29
28
28
27
18
16
17
15
32
20
1
12
4
26
25
38
37
22
23
21
33

16
15
14
6
13
5
20
6
2
7
1
10
12
8
9
4
3
24

DEVICE FOR PROJECTING A WALL COATING, PARTICULARLY FOR AN EXCAVATION

BACKGROUND OF THE INVENTION

The invention relates to a device for simultaneously projecting a liquid or pasty product and a powdery, granulous or fibrous filler to make a reinforced plastic wall coating, in which the product is brought by pumping to a centrifugal projection member with central supply channel.

Devices of this type for projecting a coating by a so-called "guniting" process are known, in which the coating may be a mortar, plaster or a resin setting on the projected surface. At the same time, a powdery, granulous or fibrous filler may have to be projected, particularly a glass fibre filler. For example, to render rocky walls tight and to prevent falls of granulous or powdery materials, a coating of aminoplastic resin is currently used, projected with shredded glass fibres. Of course, the applications of the invention will not be limited to this particular application, nor to the products mentioned.

The known apparatus require that an operator be present in the immediate vicinity. It is an object of the invention to propose a new device which is simpler to use than the known devices, conveniently usable in excavations, even those inacessible to a man or with difficult access, and therefore remotely controllable and operating reliably and safely, this requiring the absence of risk of blocking.

SUMMARY

The aim of the invention is attained with a device of the type described hereinabove, comprising, for projecting the product, a revolving spray device, with its central supply means and, for projecting the powdery filler, a centrifugal wheel and a means for supplying the filler to the centrifugal wheel, the revolving spray device and the centrifugal wheel advantageously being mounted on the same shaft in the vicinity of each other.

In this way, a circular projection is obtained which enables a whole section of an excavation, such as gallery, tunnel, well, bore hole, to be coated.

According to the invention, the means for supplying the filler to the centrifugal wheel is constituted by a pneumatic conveyor pipe which opens out in the axis of the centrifugal wheel on the side opposite the revolving spray device, and the centrifugal wheel is generally conical in shape, with its apex directed towards the discharge end of the pneumatic conveyor pipe.

In this way, the granules, particles or fibres impinge axially on the cone of the centrifugal wheel and said wheel projects them radially, but they conserve a considerable force bending their path of projection in the direction of the transverse plane of projection of the coating product by the revolving spray device.

To obtain a suitable force of projection, the shaft of the revolving spray device, and of the centrifugal wheel is advantageously driven by a motor. In fact, as soon as the section of the excavation is large, or with a viscous product, the force of reaction of the product ejected at the end of the arms of the revolving spray device will be insufficient to set it in motion.

To facilitate coating of walls of excavations, such as galleries, tunnels, wells, bore holes, the device according to the invention comprises means for support in translation on the walls, which means advantageously serve as centering means and ensure that the axis of the revolving spray device and the direction of translation are parallel.

If operation is carried out in an excavation included in an airway, such as a galery, tunnel, well or a drill hole which is not a cul-de-sac, the speed of coating of the material constituting the filler will be improved by arranging the device so that the centrifugal wheel is upstream of the revolving spray device with respect to the flow of air.

BRIEF DESCRIPTION OF THE DRAWINGS

In order to show the advantages of the invention more clearly, an embodiment by way of example will now be described with reference to the accompanying drawings, in which.

DESCRIPTION OF PREFERRED EMBODIMENTS

Figure 2:
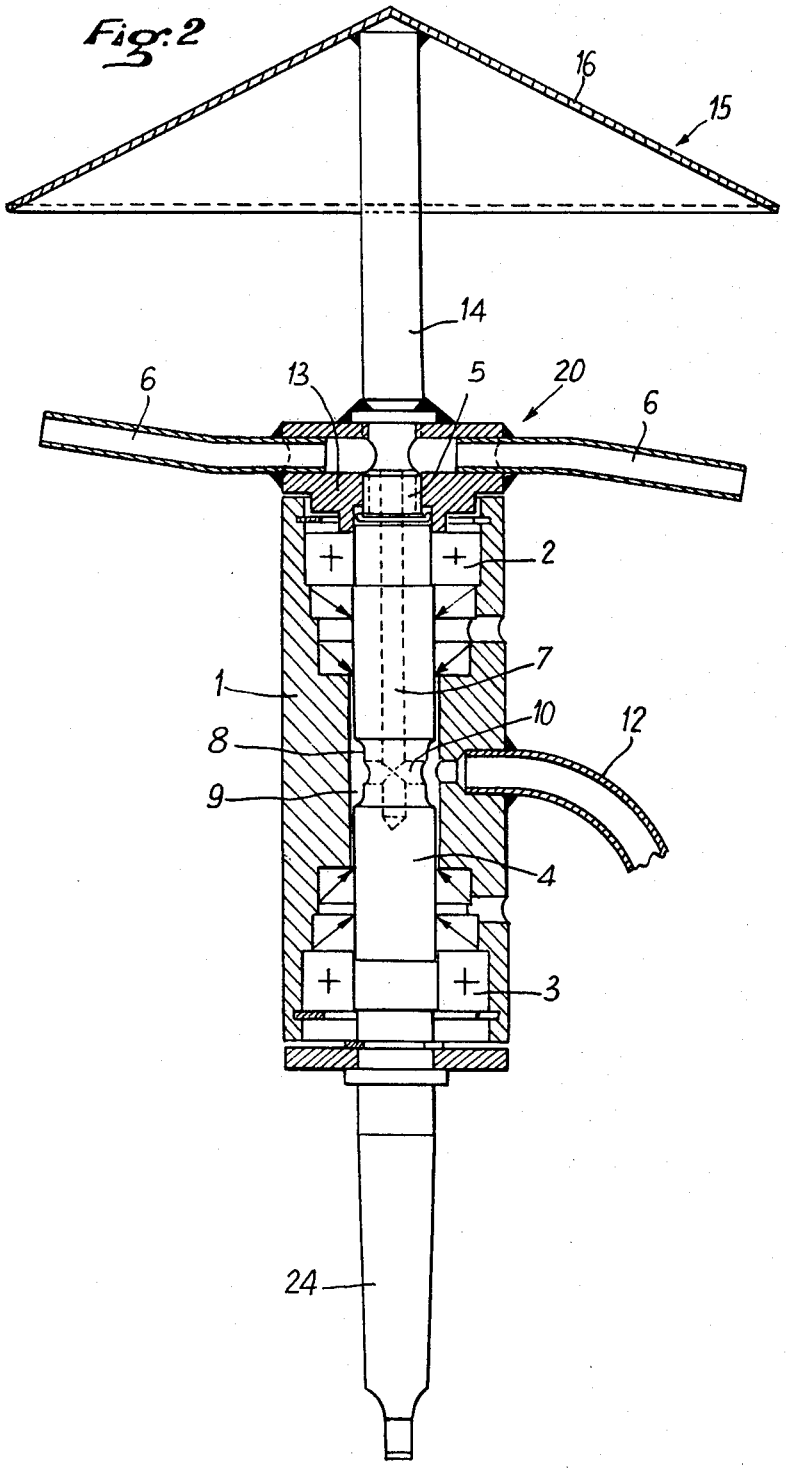
FIG. 2 shows, on a larger scale, a view in axial section of the essential part, according to the invention, of the device of FIG. 1.

Reference will firstly be made to FIG. 2.

A casing 1 is constituted by a tight ball bearing element, with two ball bearings 2 and 3 provided near its ends, for a shaft 4 which passes therethrough.

At one of its ends 5, the shaft 4 bears a hub 13 through which tubes 6 pass at regular angular distances, for example two tubes at 180° with respect to each other, substantially radial from the hub, then slightly bent, open at their ends remote from the axis and communicating on the axis with a central channel 7 provided in the axis of the shaft 4 and extending up to an annular groove 8 in the shaft 4 defining an annular chamber 9 between shaft and casing. A transverse channel 10 places the central channel 7 in communication with the annular chamber 8, in which opens a channel 11 passing through the casing 1, itself connectable to a supply pipe 12. The assembly described up to now constitutes a revolving spray device 20 with central supply channel for projecting the product which may be supplied under pressure via pipe 12.

Figure 1:
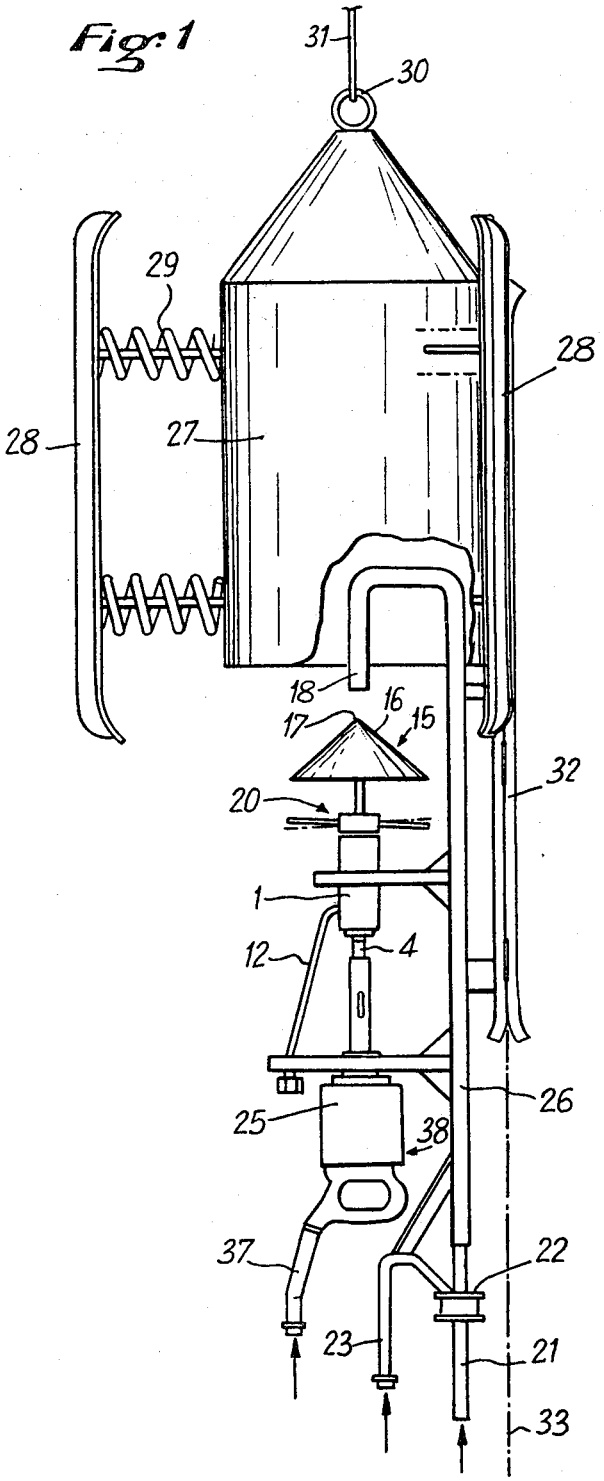
FIG. 1 shows a general side view of a device according to the invention, adapted to coat the wall of a bore hole.

The hub 13 bears, on the side opposite shaft 4, a short shaft 14 whose axis is in line with the axis of shaft 4 and which bears at its end a wheel 15 in the form of an obtuse cone 16 of which the apex 17 is directed opposite the revolving spray device. Referring now to FIG. 1, it is seen that a pipe 18 opens out in the axis of the wheel 15 near the apex 17 of the cone 16. The pipe 18 is a pneumatic conveyor pipe for supplying previously shredded glass fibres, or other suitable, pneumatically conveyable material, from a storage hopper 19 (FIG. 3) by suction in a pipe 21 due to an ejector 22 supplied with compressed air by a pipe 23.

In its lower part, the shaft 4 is shaped as a cone 24 for fixing to a motor 38 constituted by a compressed air-actuated rotary drilling machine 25 supplied with compressed air via a pipe 37.

The assembly constituted by the revolving spray device 20 and its casing 1, the centrifugal wheel 15, the drilling machine 25, the pipe 18 and its ejector 22, as well as the pipes connected thereto, is mounted on a frame 26 which has only been summarily shown. A central tubular element 27 coaxial with respect to the revolving spray device 20 is connected to the frame 26 and is disposed so as to clear the planes of projection of the revolving spray device and the centrifugal wheel. FIG. 1 shows the central tubular element opposite the casing and the drilling machine with respect to the revolving spray device, but it might also surround the casing and the drilling machine, provided that the planes of projection are cleared. The central tubular element 27 bears three skis 28 mounted on springs 29 to center the device in an excavation. The tubular element 27 terminates in a cone 29 and a ring 30 to connect the whole device to a towing cable 31. The frame 26 further comprises a guide 32 for the return part 33 of the towing cable 31.

Figure 3:
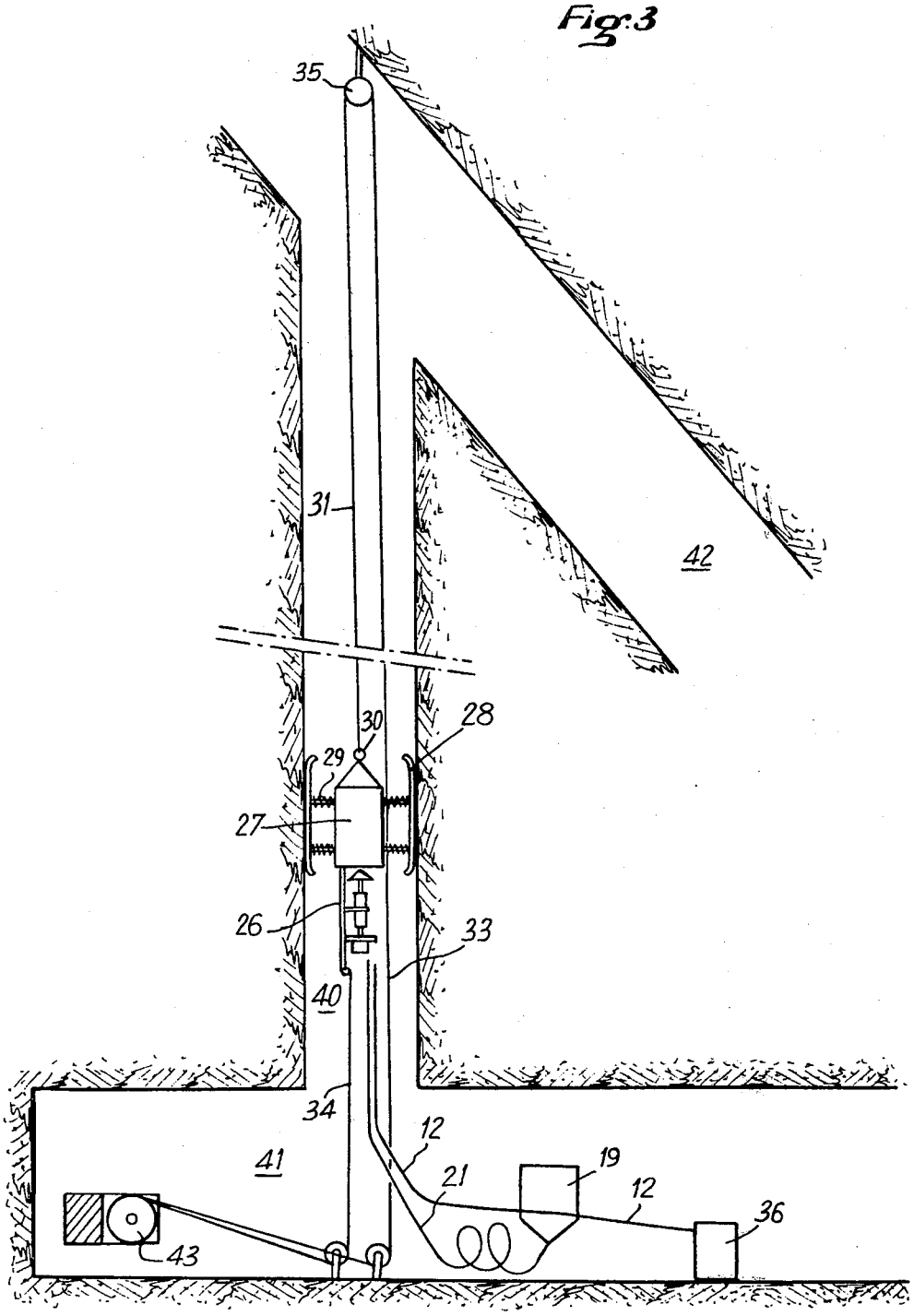
FIG. 3 is a simplified diagram illustrating the possible use of the apparatus of FIG. 1 in a bore hole.

FIG. 3 shows an application to the remote spraying of a glass fibre reinforced resin to consolidate the walls of a 600 mm bore hole 40 in coal-bearing ground and simultaneously to prevent oxidation of the ground in the carbonaceous zones. The purpose of boring the hole 40 was to improve aeration in a road 41 being opened up from a galery 42 of an area being exploited and to serve as emergency exit. After the hole 40 is bored, a winch 43 is installed in the road 41 for an endless cable 34, 33, 31 guided by a pulley 35 installed in the galery 42. The device of the invention is towed into the bore hole, with the aid of the ring 30. The revolving spray device is supplied with resin from a pumping station 36 through pipe 12 and the centrifugal wheel is supplied with shredded glass fibres, as has already been set forth.

The bore hole further comprises one or more compressed air pipes 23, 37 which have not been shown in FIG. 3 in order to simplify the drawings, but which are of conventional type in mines.

I claim:

1. A device for simultaneously projecting a liquid or pasty product and a pulverulent or granulous or fibrous filler to make a reinforced plastic wall coating, comprising a casing, a shaft arranged to rotate freely in said casing, said shaft extending through said casing and having one end outside said casing drivingly connected to a motor means, an opposite end extending from the other side of said casing, a centrifugal projecting means mounted on said opposite end for rotation therewith, a spray device mounted between said casing and said opposite end substantially transversely of said shaft for rotation therewith for projecting the product under pressure, said shaft having a central channel in communication with said spray device, said centrifugal projecting means comprising an obtuse cone having an apex directed opposite said spray device, a pipe with a first end opened towards said obtuse cone and a second end in communication with a means for supplying the filler.

2. The device as claimed in claim 1 wherein said spray device and said centrifugal means are mounted in the vicinity of each other.

3. The device as claimed in claims 1 or 2 wherein said means for supplying said filler is a pneumatic conveyor pipe.

4. The device of claim 1 wherein said device comprises means for support in translation on the wall of an excavation.

* * * * *